US009033764B2

(12) United States Patent
Kitamura et al.

(10) Patent No.: US 9,033,764 B2
(45) Date of Patent: May 19, 2015

(54) METHOD OF POLISHING OBJECT TO BE POLISHED

(75) Inventors: Kazumasa Kitamura, Ichinomiya (JP); Tomoki Nagae, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 841 days.

(21) Appl. No.: 13/225,961

(22) Filed: Sep. 6, 2011

(65) Prior Publication Data

US 2012/0064803 A1 Mar. 15, 2012

(30) Foreign Application Priority Data

Sep. 9, 2010 (JP) ..... 2010-201729
Sep. 2, 2011 (JP) ..... 2011-191422

(51) Int. Cl.

| | |
|---|---|
| ***B24B 1/00*** | (2006.01) |
| ***B24B 37/04*** | (2012.01) |
| ***B24B 7/22*** | (2006.01) |
| ***B24B 37/26*** | (2012.01) |
| ***B24B 37/005*** | (2012.01) |
| ***B24B 13/00*** | (2006.01) |
| ***B24B 37/00*** | (2012.01) |
| ***B24B 57/02*** | (2006.01) |

(52) U.S. Cl.

CPC ..... *B24B 37/042* (2013.01); *B24B 7/228* (2013.01); *B24B 37/26* (2013.01); *B24B 37/0056* (2013.01); *B24B 13/00* (2013.01); *B24B 37/00* (2013.01); *B24B 57/02* (2013.01)

(58) Field of Classification Search

CPC ..... B24B 37/26; B24B 37/042; B24B 7/228; B24B 37/0056; B24D 13/14; B24D 11/04; B24D 13/142

USPC ..... 451/41, 57, 59, 63, 65, 527, 548, 550

See application file for complete search history.

(56) References Cited

U.S. PATENT DOCUMENTS 3,583,111 A 6/1971 Volk
5,441,598 A * 8/1995 Yu et al. ..... 438/692

(Continued)

FOREIGN PATENT DOCUMENTS

CN 1461251 A 12/2003
DE 196 02 458 A1 12/1996

(Continued)

OTHER PUBLICATIONS

Japanese Office Action, Japanese Application No. 2011-191422, dated Apr. 1, 2014 (2 pages).

(Continued)

*Primary Examiner* — Timothy V Eley
(74) *Attorney, Agent, or Firm* — Burr & Brown, PLLC

(57) ABSTRACT

The present invention provides: a method of polishing an object to be polished for processing a surface of the object to be polished into a concave or convex state with a high degree of accuracy; and a polishing pad. An object to be polished is placed on a polishing pad over the boundary between the first polishing region and the second polishing region, the first polishing region has grooves and the second polishing region has grooves different from those of the first polishing region, and either one of the two regions being formed on a region on the center side, and the other on the outer side in a radial direction on the surface of the polishing pad; and the object to be polished is polished by rotating the polishing pad and the object to be polished.

11 Claims, 10 Drawing Sheets

(56) References Cited

U.S. PATENT DOCUMENTS

| | | | | |
|---|---|---|---|---|
| 5,679,063 | A | 10/1997 | Kimura et al. | |
| 6,123,608 | A | 9/2000 | Nakagawa et al. | |
| 6,165,904 | A | 12/2000 | Kim | |
| 6,276,991 | B1 | 8/2001 | Kobayashi et al. | |
| 6,607,423 | B1 * | 8/2003 | Arcayan et al. | 451/8 |
| 6,964,598 | B1 * | 11/2005 | Leong et al. | 451/6 |
| 7,137,874 | B1 | 11/2006 | Bovio et al. | |
| 7,300,340 | B1 | 11/2007 | Elmufdi et al. | |
| 2005/0107008 | A1 | 5/2005 | Miyazawa | |
| 2006/0099889 | A1 | 5/2006 | Tabata et al. | |
| 2010/0159811 | A1 | 6/2010 | Muldowney | |

FOREIGN PATENT DOCUMENTS

| | | | |
|---|---|---|---|
| EP | 0 054 368 | A2 | 6/1982 |
| JP | 2000-117620 | A | 4/2000 |
| JP | 2000-155924 | A1 | 6/2000 |
| JP | 2003-173992 | A1 | 6/2003 |
| JP | 2004-327567 | A1 | 11/2004 |
| JP | 2006-159398 | A | 6/2006 |
| JP | 2007-005482 | A1 | 1/2007 |
| JP | 2007-054944 | A1 | 3/2007 |
| JP | 2008-068394 | A1 | 3/2008 |
| JP | 2009-000749 | A1 | 1/2009 |
| JP | 2010-155339 | A1 | 7/2010 |

OTHER PUBLICATIONS

Japanese Office Action (Application No. 2011-191422) dated Jun. 24, 2014.

Extended European Search Report (Application No. 11180163.5) dated Nov. 14, 2014.

Chinese Office Action (Application No. 201110265297.0) dated Oct. 29, 2014.

* cited by examiner

METHOD OF POLISHING OBJECT TO BE POLISHED

BACKGROUND OF THE INVENTION

1. Field of the Invention

The present invention relates to: a method of polishing an object to be polished for processing the surface of the object to be polished into a convex or concave state; and a polishing pad.

2. Description of Related Art

Chemical mechanical polishing (CMP) has heretofore been applied in order to flattening the surface of an object to be polished such as a semiconductor wafer. In CMP, the polishing amount of the surface of an object to be polished is likely to be uneven on the surface. A technology for polishing an object to be polished uniformly and improving flatness is disclosed (for example, JP-A-2009-327567).

SUMMARY OF THE INVENTION

However, in the case of an optical component, for example, a wafer having a concave or convex surface is required sometimes. Previously, development has been advanced in the direction of improving flatness and there has been no technology of forming a concave or convex surface with a high degree of accuracy.

An object of the present invention is to provide: a polishing method of an object to be polished for processing a surface of the object to be polished into a concave or convex state with a high degree of accuracy by polishing the surface; and a polishing pad.

A method of polishing an object to be polished according to the present invention makes it possible to process the surface of the object to be polished such as a semiconductor wafer into a concave or convex state.

In order to solve the problem, the present invention provides a method of polishing an object to be polished and a polishing pad, stated below.

[1] A method of polishing an object to be polished, wherein the surface of the object to be polished is processed into a concave or convex state by: placing an object to be polished on a polishing pad over the boundary between a first polishing region and a second polishing region, the polishing pad having a first polishing region where grooves are formed and a second polishing region where grooves are formed in a different state from that of the first polishing region, and either one of the first polishing region and the second polishing region being formed on a region on the center side, and the other being formed on a region on the outer side in a radial direction on the surface of the polishing pad; and polishing the object to be polished by rotating the polishing pad and the object to be polished.

[2] The method of polishing an object to be polished according to [1], wherein the first polishing region is formed on the center side of the polishing pad and the surface of the object to be polished is processed into a concave state.

[3] The method of polishing an object to be polished according to [1], wherein the first polishing region is formed on the outer side of the polishing pad and the surface of the object to be polished is processed into a convex state.

[4] The method of polishing an object to be polished according to any one of [1] to [3], wherein concentric grooves are formed in the first polishing region of the polishing pad.

[5] A polishing pad, which has a first polishing region where grooves are formed and a second polishing region where grooves are formed in a different state from that of the first polishing region, wherein either one of the first polishing region and the second polishing region is formed on a region on the center side, and the other is formed on a region on the outer side in a radial direction on the surface of the polishing pad.

[6] A method of polishing an object to be polished, wherein the surface of the object to be polished is processed into a concave or convex state by: placing an object to be polished on a polishing pad having grooves formed on its surface; polishing the object to be polished by rotating the polishing pad and the object to be polished at number of revolutions different from each other so as to make polishing speed have a distribution on the surface of the object to be polished.

[7] The method of polishing an object to be polished according to [6], wherein the surface of the object to be polished is processed into a concave state by making the number of revolutions of the polishing pad larger than that of the object to be polished.

[8] The method of polishing an object to be polished according to [6], wherein the surface of the object to be polished is processed into a convex state by making the number of revolutions of the polishing pad smaller than that of the object to be polished.

[9] A method of polishing an object to be polished, wherein the surface of the object to be polished is processed into a concave or convex state by: placing an object to be polished on a polishing pad having grooves formed on its surface; and polishing the object to be polished by rotating the polishing pad and the object to be polished while supplying one of two slurries having different properties each other to a region of the polishing pad on the center side of the central part of the object to be polished in a radial direction of the polishing pad, and supplying the other slurry to a region of the of the polishing pad on the outer side of the central part of the object to be polished, respectively, or supplying a specified slurry to only one of the said two regions.

[10] The method of polishing an object to be polished according to [9], wherein the two slurries having different properties each other are ones having different pHs each other.

A method of polishing an object to be polished according to the present invention makes it possible to process the surface of the object to be polished into a concave or convex state. Since polishing conditions can be determined by the type of a polishing pad, number of revolutions, and slurry, the optimization of the conditions is facilitated.

It is possible to process the surface of an object to be polished into a concave or convex state by polishing the object to be polished with a polishing pad according to the present invention.

DETAILED DESCRIPTION OF THE PRESENT INVENTION

Embodiments of the present invention will be hereunder explained with reference to drawings. The present invention is not limited to the following embodiments and can be changed, corrected, and modified without departing from the scope of the present invention.

Embodiment 1

Figure 1:
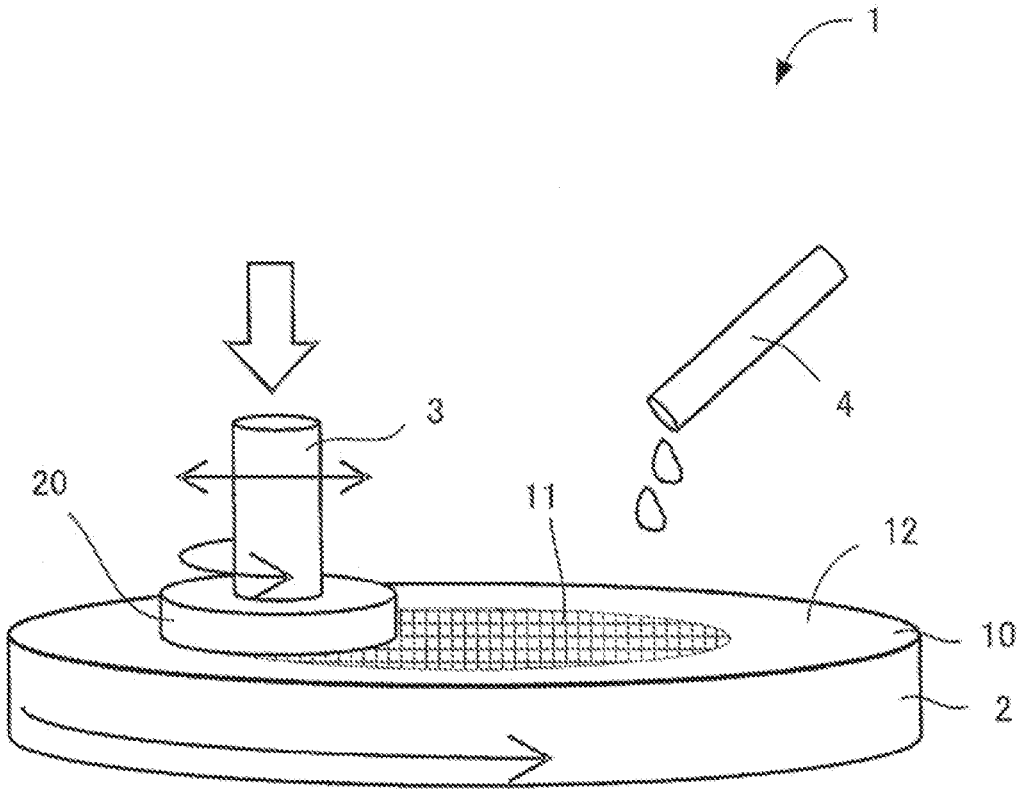
FIG. 1 is a schematic view showing a CMP apparatus.

A polishing method according to the present invention is a polishing method used in chemical mechanical polishing (CMP) for polishing the surface of an object to be polished such as a semiconductor wafer. A schematic view of a CMP apparatus 1 is shown in FIG. 1. The CMP apparatus 1 includes a platen 2, a polishing head 3, and a slurry supply unit 4. A polishing pad 10 is attached to the platen 2. The surface of an object to be polished 20 is polished chemically and mechanically by: supplying slurry onto the polishing pad 10 from the slurry supply unit 4; rotating the platen 2; and rotating the polishing head 3 in the same direction as the platen 2 while the polishing head 3 pushes the object to be polished 20 positioned on the polishing pad 10, with respect to the polishing pad 10.

A polishing pad 10 according to the present invention, has a first polishing region 11 where grooves 15 are formed and a second polishing region 12 where grooves 15 are formed in a different state from that of the first polishing region 11, wherein either one of the first polishing region 11 and the second polishing region 12 is formed on a region on the center side, and the other is formed on a region on the outer side in a radial direction on the surface of the polishing pad 10. Here, the expression "different state from that of the first polishing region" includes a state where grooves 15 different from the ones of the first polishing region 11 are formed, or a state where no groove 15 is practically formed. Incidentally, even though there is formed no apparent groove 15 in the second polishing region 12, the object to be polished 20 may be polished to a certain degree by this second polishing region 12 due to the friction between the surface of the second polishing region 12 and that of the object to be polished 20. The first polishing region 11 is a region where polishing is prone to proceed compared to the second polishing region 12. That is, the amount to be polished is larger in the first polishing region 11 compared to the second polishing region 12. As such, the first polishing region 11 may have more grooves in number per unit length in the radial direction compared to the second polishing region 12. The number, depth, width and the like of the grooves 15 of the first polishing region 11 may be freely chosen, depending upon the kind of the object to be polished 20, the aim of the polishing and the like. However, the width of the grooves 15 of the first polishing region 11 may be 0.2 mm to 0.8 mm, and the pitch of the grooves 15 (the distance between the centers of two grooves 15) may be about 1 mm to 2 mm. In case of the second polishing region 12, grooves 15 may not be formed and the intact surface of a virgin polishing pad itself may be employed as it is. Indeed, when the grooves 15 are formed, the width of the grooves 15 may be 0.2 mm to 0.8 mm, and the pitch of the grooves 15 may be about 2.5 mm to 3.5 mm. Incidentally, in the case of processing the surface of an object to be polished 20 into a convex state, the first polishing region 11 is formed on a region on the outer side and the second polishing region 12 on the inner side. In the case of processing the surface of an object to be polished 20 into a concave state, the first polishing region 11 is formed on a region on the inner side and the second polishing region 12 on the outer side.

Figure 2A:
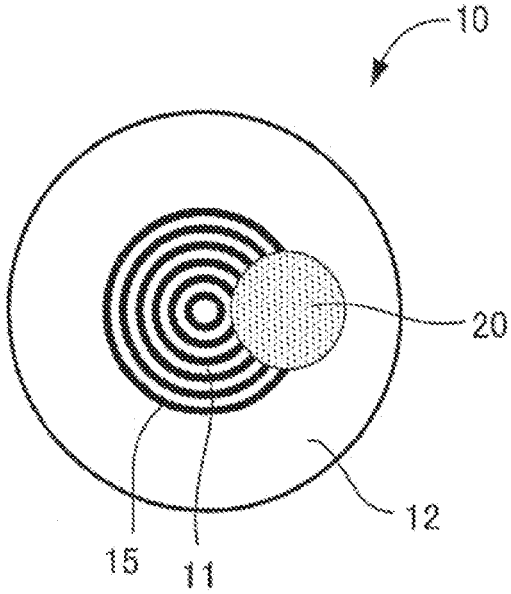
FIG. 2A is a schematic view showing an embodiment of a polishing pad having a first polishing region formed on the center side.

An embodiment of a polishing pad 10 is shown in FIG. 2A (an object to be polished 20 is placed in FIG. 2A). The polishing pad 10 is formed into a disk shape, has a plurality of grooves 15 processed on the surface, is attached to a platen 2, and polishes an object to be polished 20. The polishing pad 10 is formed of, for example, foamed rigid urethane, suede or the like.

FIG. 2A shows a polishing pad 10 having a first polishing region 11 formed on the center side in a radial direction and having concentric grooves 15 formed in the first polishing region 11. The region on the outer side in a radial direction is a second polishing region 12. FIG. 2A shows a case where the grooves 15 are not formed. It is possible to process the surface of an object to be polished 20 into a concave state (lower right side in FIG. 3) by using a polishing pad 10 having a first polishing region 11 formed on the center side as shown in FIG. 2A.

Figure 2B:
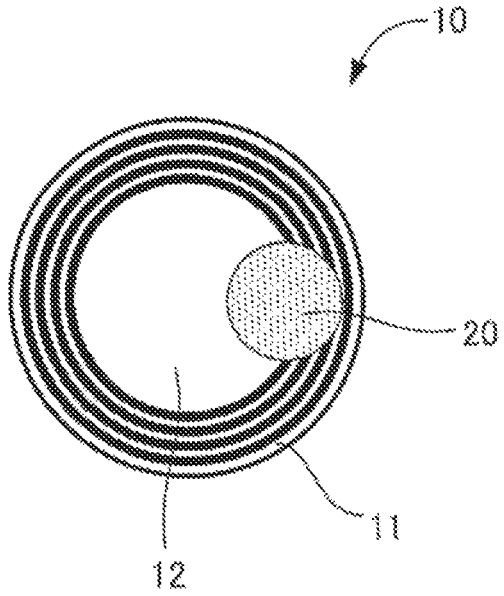
FIG. 2B is a schematic view showing an embodiment of a polishing pad having a first polishing region formed on the outer side.

FIG. 2B shows a polishing pad 10 having a first polishing region 11 formed on the outer side and having concentric grooves 15 formed in the first polishing region 11 (an object to be polished 20 is placed in FIG. 2B). The region on the center side is a second polishing region 12. FIG. 2B shows a case where the grooves 15 are not formed. It is possible to process the surface of an object to be polished 20 into a convex state (lower left side in FIG. 3) by using a polishing pad 10 having a first polishing region 11 formed on the outer side as shown in FIG. 2B.

Figure 2C:
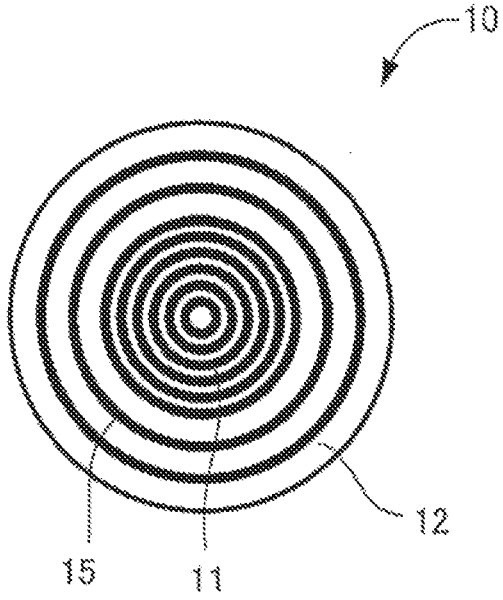
FIG. 2C is a schematic view showing an embodiment of a polishing pad having, on the outer side, a second polishing region with grooves formed.
Figure 2D:
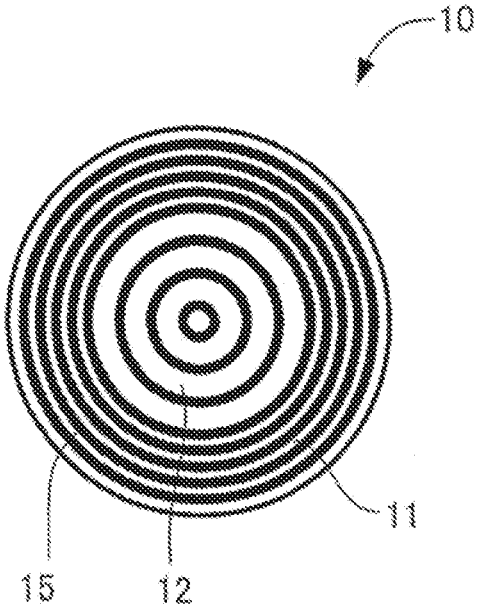
FIG. 2D is a schematic view showing an embodiment of a polishing pad having, on the center side, a second polishing region with grooves formed.

Embodiments wherein grooves 15 are formed in the second polishing region are shown in FIGS. 2C and 2D. FIG. 2C shows an embodiment where the second polishing region 12 is formed on the outer side of the polishing pad 10 with a small number of grooves 15. FIG. 2D shows an embodiment where the second polishing region 12 is formed on the center side of the polishing pad 10 with a small number of grooves 15. The second polishing region 12 has a smaller number of grooves 15 per unit length in the radial direction compared with the first polishing region 11.

Figure 3:
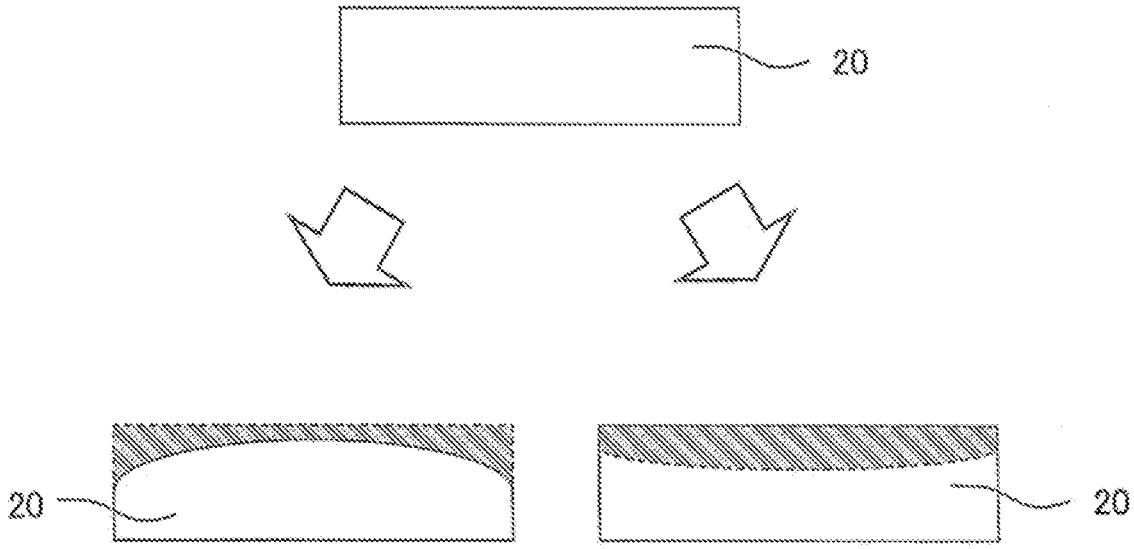
FIG. 3 comprises sectional views showing an object to be polished before being polished in the upper side, an object to be polished having polished into a concave surface at the lower right side, and an object to be polished having polished into a convex surface at the lower left side.

A method of polishing an object to be polished according to the present invention comprises the steps of: placing an object to be polished 20 on a polishing pad 10 over the boundary between the first polishing region 11 and the second polishing region 12, the polishing pad 10 having a first polishing region 11 where grooves 15 are formed and a second polishing region 12 where grooves 15 are formed in a different state from that of the first polishing region, and either one of the first polishing region 11 and the second polishing region 12 being formed on a region on the center side, and the other being formed on a region on the outer side in a radial direction on the surface of the polishing pad 10; and polishing the object to be polished 20 by rotating the polishing pad 10 and the object to be polished 20. Then, as shown in FIG. 3, the surface of the object to be polished 20 is processed into a concave (lower right side in FIG. 3) or convex (lower left side in FIG. 3) state. By the method of polishing an object to be polished according to the present invention, it is possible to form a concave or convex crowning shape having a curvature radius of R 2 million mm to R 50 million mm.

Examples of an object to be polished 20 in a method of polishing an object to be polished according to the present invention are: semiconductor wafers including Si, $SiO_2$, etc.; monocrystal wafers including LN, LT, GaN, etc.; ceramics including alumina, zirconia, piezoelectric body, etc.; and metals including alloys of beryllium, copper, etc.

Figure 4A:
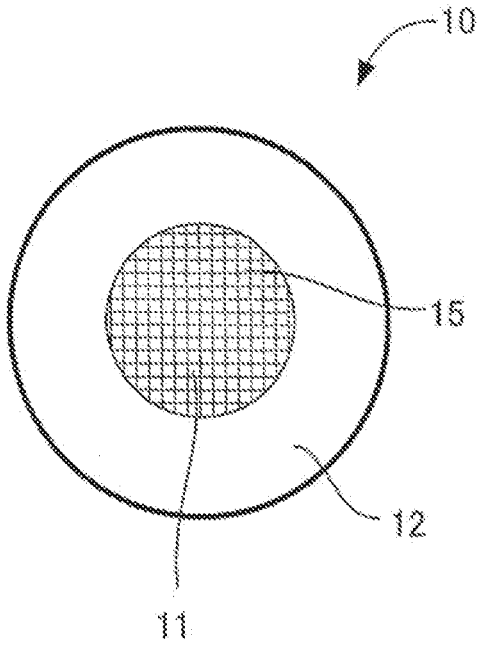
FIG. 4A is a schematic view showing a polishing pad having a first polishing region formed on the center side and having lattice-shaped grooves formed in the first polishing region.
Figure 4B:
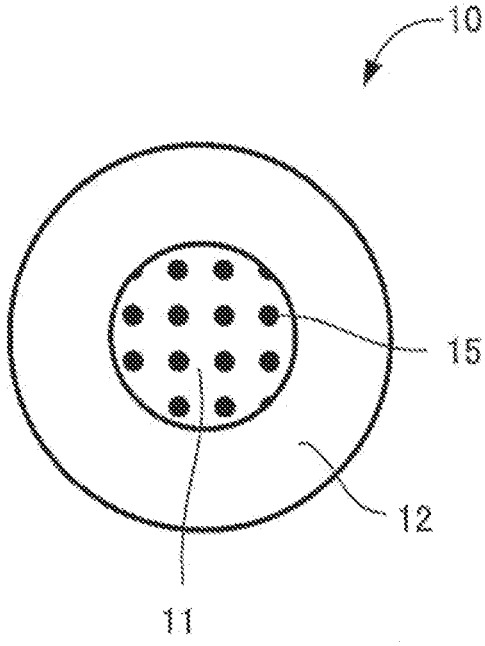
FIG. 4B is a schematic view showing a polishing pad having a first polishing region formed on the center side and having hole-shaped grooves formed in the first polishing region.
Figure 4C:
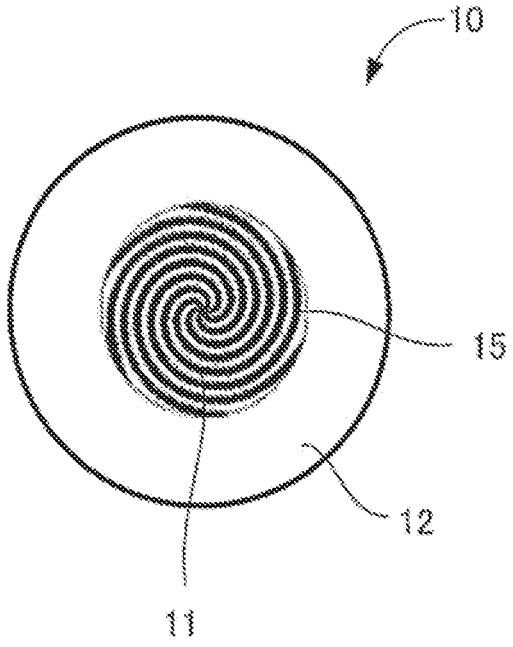
FIG. 4C is a schematic view showing an embodiment of a polishing pad having a first polishing region formed on the center side and having spiral-shaped grooves formed in the first polishing region.
Figure 4D:
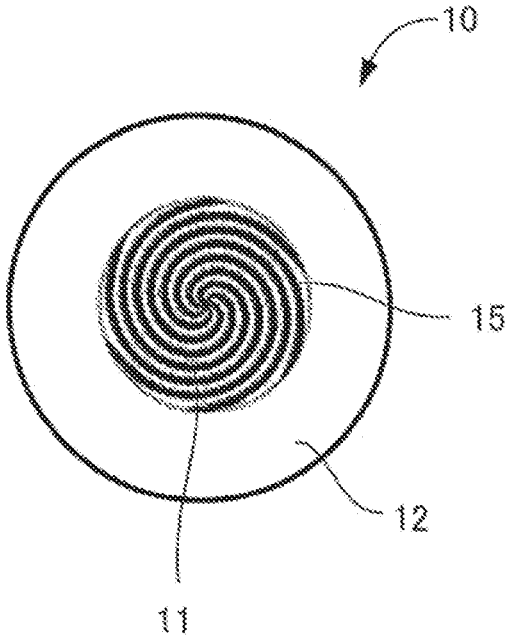
FIG. 4D is a schematic view showing another embodiment of a polishing pad having a first polishing region formed on the center side and having spiral-shaped grooves formed in the first polishing region.

Other embodiments of a polishing pad 10 are shown in FIGS. 4A to 4D. FIG. 4A shows a polishing pad 10 having a first polishing region 11 formed on the center side and having lattice-shaped grooves 15 formed in the first polishing region 11. FIG. 4B shows a polishing pad 10 having a first polishing region 11 formed on the center side and having hole-shaped grooves 15 formed in the first polishing region 11. Each of FIGS. 4C and 4D shows a polishing pad 10 having a first polishing region 11 formed on the center side and having spiral-shaped grooves 15 formed from the center of the polishing pad 10 in the first polishing region 11. It is possible to process the surface of an object to be polished 20 into a concave state (lower right side in FIG. 3) by using a polishing pad 10 having a first polishing region 11 formed on the center side as shown in FIGS. 4A to 4D.

It should be noted that, although each of FIGS. 4A to 4D is the case of a polishing pad 10 having a first polishing region 11 formed on the center side, it is also possible to form a first polishing region 11 in the region on the outer side as shown in FIG. 2B. In the case of a polishing pad 10 having a first polishing region 11 formed on the outer side, it is possible to process the surface of an object to be polished 20 into a convex state (lower left side in FIG. 3).

Embodiment 2

A method of polishing an object to be polished according to Embodiment 2 of the present invention will be explained by the use of FIG. 5. The method of polishing an object to be polished according to Embodiment 2 of the present invention comprises the steps of placing an object to be polished 20 on a polishing pad 10 having grooves 15 formed on its surface; and polishing the object to be polished 20 by rotating the polishing pad 10 and the object to be polished 20 at number of revolutions different from each other so as to make polishing speed have a distribution on the surface of the object to be polished 20. By so doing, it is possible to process the surface of the object to be polished 20 into a concave or convex state.

Figure 5:
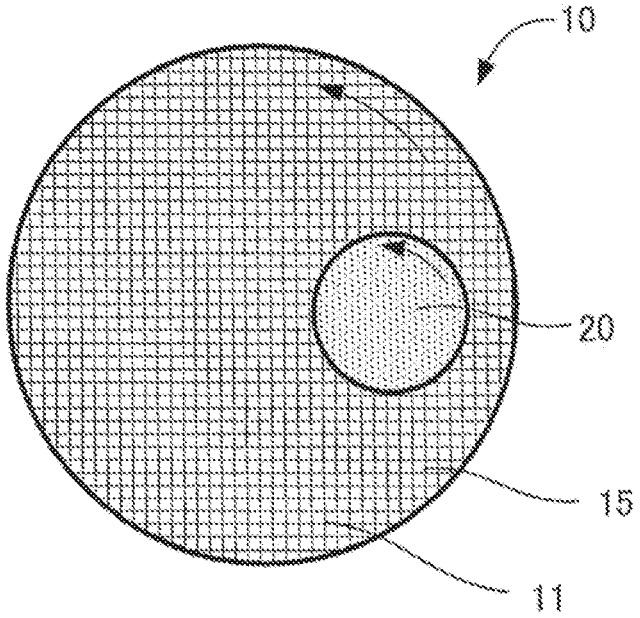
FIG. 5 is a schematic view explaining a polishing method of rotating a polishing pad and an object to be polished at number of revolutions different from each other.

A polishing pad shown in FIG. 5 has a first polishing region 11 on the whole surface and lattice-shaped grooves 15 are formed in the first polishing region 11. It should be noted that, a polishing pad 10 used in the method of polishing an object to be polished according to Embodiment 2 may be any polishing pad as long as grooves 15 are formed on the whole surface. The shape of the grooves in the first polishing region 11 is not limited.

The revolution speed of a platen 2 (a polishing pad 10) is preferably 5 to 1,000 rpm, more preferably 10 to 500 rpm, and further preferably 1.0 to 150 rpm.

The revolution speed of an object to be polished 20 is preferably 5 to 1,000 rpm, more preferably 10 to 500 rpm, and further preferably 10 to 150 rpm.

The difference between the revolution speed of a platen 2 (a polishing pad 10) and the revolution speed of an object to be polished 20 is preferably 0 to 500 rpm (here 0 rpm is excluded), more preferably 0 to 450 rpm, and further preferably 0 to 100 rpm. If the increase in the curvature radius of the surface to be polished of an object to be polished 20 is required (for example, 50 million mm), it is preferable to bring the difference of the revolution speeds close to 0, but 0 rpm is not included.

It is possible to process the surface of the object to be polished 20 into a concave state by making the number of revolutions of the polishing pad 10 larger than that of the object to be polished 20.

Furthermore, it is possible to process the surface of the object to be polished 20 into a convex state by making the number of revolutions of the polishing pad 10 smaller than that of the object to be polished 20.

Embodiment 3

A method of polishing an object to be polished according to the present invention comprises the steps of: placing the object to be polished 20 on a polishing pad 10 having grooves 15 formed on its surface; and polishing the object to be polished 20 by rotating the polishing pad 10 and the object to be polished 20 while supplying one of two slurries having different properties from each other to a region of the polishing pad 10 on the center side of the central part 20*c* of the object to be polished 20 in a radial direction of the polishing pad 10, and supplying the other slurry to a region of the polishing pad 10 on the outer side of the central part 20*c* of the object to be polished 20, respectively. Alternatively, the slurry may be supplied to only one of the said two regions, i.e. the region on the center side or the region on the outer side. By so doing, it is possible to process the surface of the object to be polished 20 into a concave or convex state.

Figure 6A:
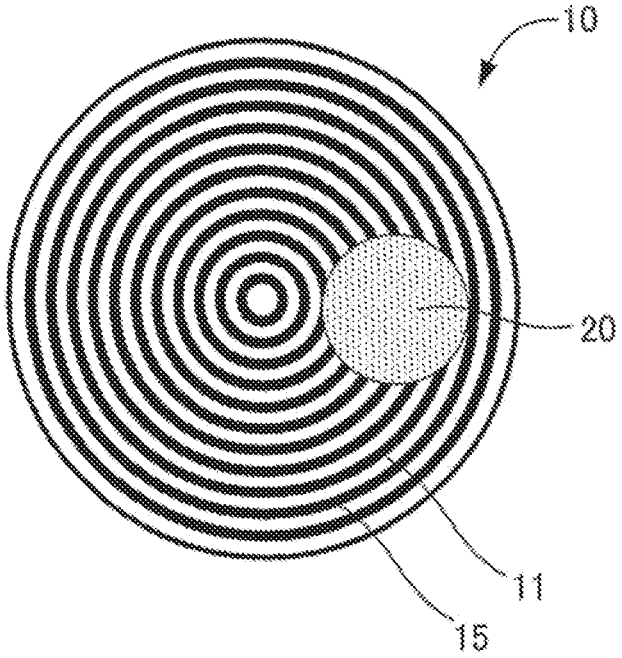
FIG. 6A is a schematic view showing a polishing pad for explaining a method of polishing an object to be polished while different slurries are supplied to a region of the polishing pad on the center side of the central part of the object to be polished and to a region of the polishing pad on the outer side of the central part of the object to be polished, respectively.
Figure 6B:
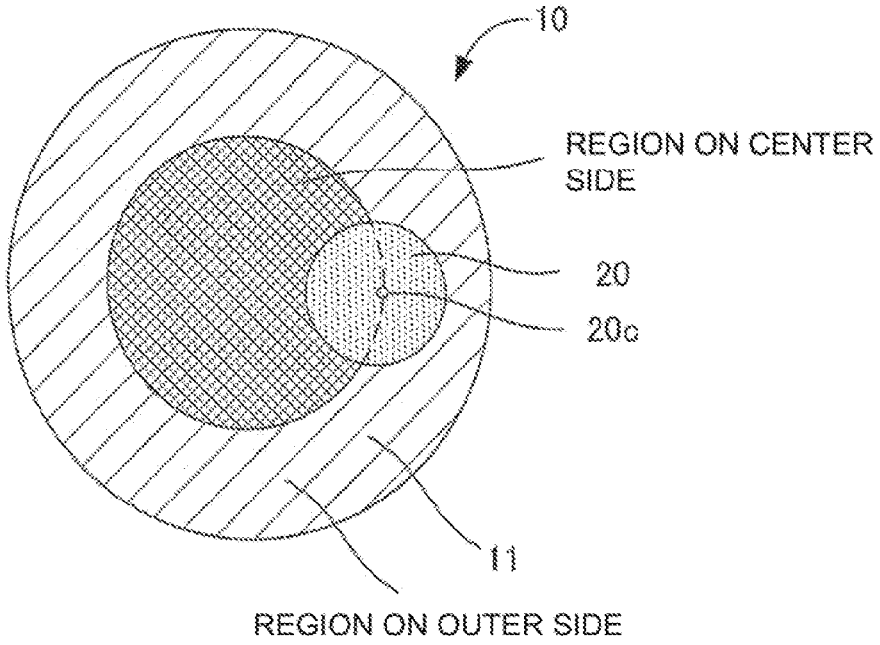
FIG. 6B is a schematic view showing a supply region of slurry for explaining a method of polishing an object to be polished while different slurries are supplied to a region of the polishing pad on the center side of the central part of the object to be polished and to a region of the polishing pad on the outer side of the central part of the object to be polished, respectively.

In Embodiment 3, a polishing pad 10 having concentric grooves 15 formed as shown in FIG. 6A is used. FIG. 6B is a schematic view showing the supply region of slurry. It is possible to form a concave surface on an object to be polished 20 by supplying slurry for polishing to the region of a polishing pad 10 on the center side of the central part 20*c* of the object to be polished 20 and supplying slurry for suppressing polishing to the region of the polishing pad 10 on the outer side of the central part 20*c* of the object to be polished 20. The slurry for polishing and the slurry for suppressing polishing have different pHs from each other. The polishing speed in the suppressing region is lower than the polishing speed in the polishing region by 30% to 100%. It should be noted that, although the shape of the grooves of the polishing pad 10 is not limited in any of the Embodiments 1 to 3, concentric grooves as shown in FIG. 6A can easily control the region where slurry is supplied and is therefore preferred in Embodiment 3.

Slurry is supplied from a slurry supply unit 4 in a CMP apparatus 1 onto the surface of a polishing pad 10. The slurry includes a polishing member, an acid, an oxidizer, and water. As a polishing member, colloidal silica, fumed silica, alumina, titania, zirconia, a mixture of these, etc. can be used. Furthermore, as an oxidizer, peroxide, nitrate, etc. can be used. Moreover, the slurry may contain a pH adjuster. As a pH adjuster, an acidic substance or a basic substance is arbitrarily used in order to adjust the pH of the slurry to a desired value.

The pH in the region of a polishing pad 10 on the center side of the central part 20*c* of an object to be polished 20 is preferably 0 to 12.0, more preferably 3.0 to 10.0, and further preferably 4.0 to 10.0. The pH in the region of a polishing pad 10 on the outer side of the central part 20*c* of an object to be polished 20 is preferably 10.0 to 14.0, more preferably 12.0 to 14.0, and further preferably 13.0 to 14.0. It should be noted that, if the pH value in the region on the center side and the pH value in the region on the outer side are reversed from the above values, concave and convex of a surface are also formed reversely. Furthermore, in the case of an object to be polished 20 is a monocrystal wafer of LN ($LiNbO_3$) for example, the polishing speed in acid (pH 3 to 5) is 200% (two times) and the polishing speed in strong alkali (pH 13 or higher) is approximately zero (0%) when the ordinary polishing speed through the use of colloidal silica is 1.

In place of using different slurries in the region of a polishing pad 10 on the center side and in the region thereof on the outer side, respectively, an object to be polished 20 may also be polished while slurry is supplied only to either the region of a polishing pad 10 on the center side of the central part 20*c* of the object to be polished 20 or the region of a polishing pad 10 on the outer side of the central part 20*c* of the object to be polished 20 in a radial direction of the polishing pad 10. By so doing, it is possible to process the surface of an object to be polished 20 into a concave or convex state.

EXAMPLES

The present invention will be hereunder explained further in detail on the basis of examples, but the present invention is not limited to these examples.

Example 1

Figure 7A:
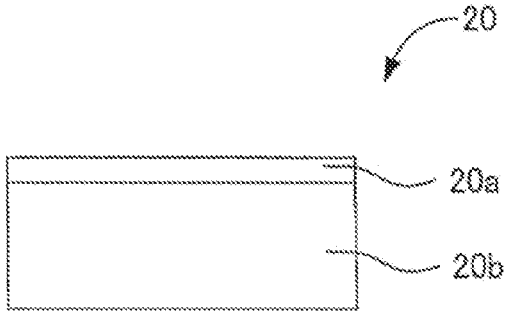
FIG. 7A is a schematic view showing a Si wafer on which an $SiO_2$ film has been formed.
Figure 7B:
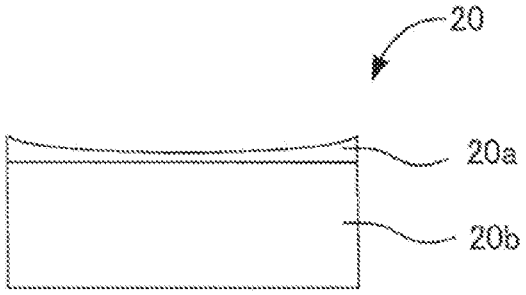
FIG. 7B is a schematic view showing a Si wafer having an $SiO_2$ film polished into a concave state by a polishing method according to the present invention.
Figure 8:
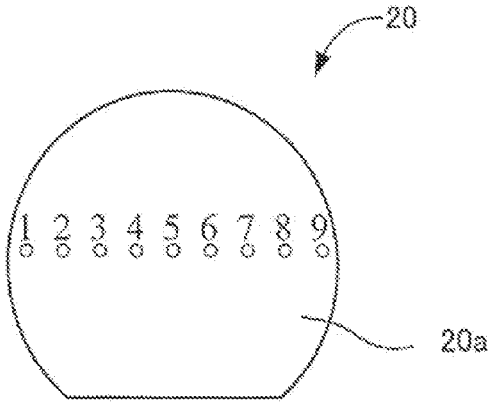
FIG. 8 is a schematic view explaining measurement positions of film thickness in the Examples.
Figure 9:
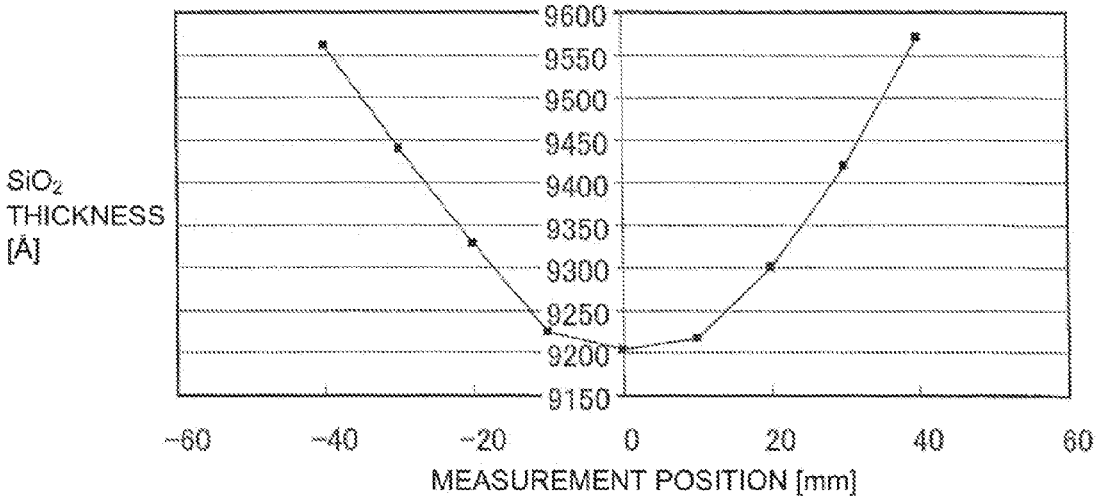
FIG. 9 is a graph showing the result of polishing through the use of a polishing pad having a first polishing region formed on the center side and having concentric grooves formed in the first polishing region.

A polishing pad 10 (FIG. 2A) having a first polishing region 11 formed on the center side and having concentric grooves 15 formed in the first polishing region 11 was attached to a CMP apparatus 1 (refer to FIG. 1) and an object to be polished 20 was polished. As slurry, a slurry containing colloidal silica as a polishing member was used. A polishing pad 10 having a diameter of 300 mm, and having a first polishing region 11 having a diameter of 150 mm on the center side where grooves 15 are formed and a second polishing region 12 having a diameter of 150 mm to 300 mm on the outer side where grooves 15 are not formed was used. The width of the grooves 15 formed on the first polishing region 11 of the polishing pad 10 was 0.5 mm and the pitch was 1.5 mm. A polishing pad 10 made of foamed rigid urethane was used. As the object to be polished 20, as shown in FIG. 7A, a Si wafer 20*b* having a diameter of 100 mm where an $SiO_2$ film 20*a* having a thickness of 10,000 Å is formed thereon was used. The object to be polished was placed at the boundary between the first polishing region 11 and the second polishing region 12 and polished as shown in FIG. 2A. Then the thickness of the $SiO_2$ film 20*a* of the wafer after having polished was measured at the positions shown in FIG. 8 through the use of a film thickness meter. The results are shown in FIG. 9. The 9 points in the range between −40 to 40 mm on the horizontal axis representing measurement position in FIG. 9 correspond to the measurement positions 1 to 9 in FIG. 8. As shown in FIG. 9, it was possible to process the surface of an object to be polished 20 into a concave state as shown in FIG. 7B by using a polishing pad 10 having a first polishing region 11 formed on the center side. In the case of FIG. 9, the curvature radius was R 36 million mm.

Example 2

Figure 10:
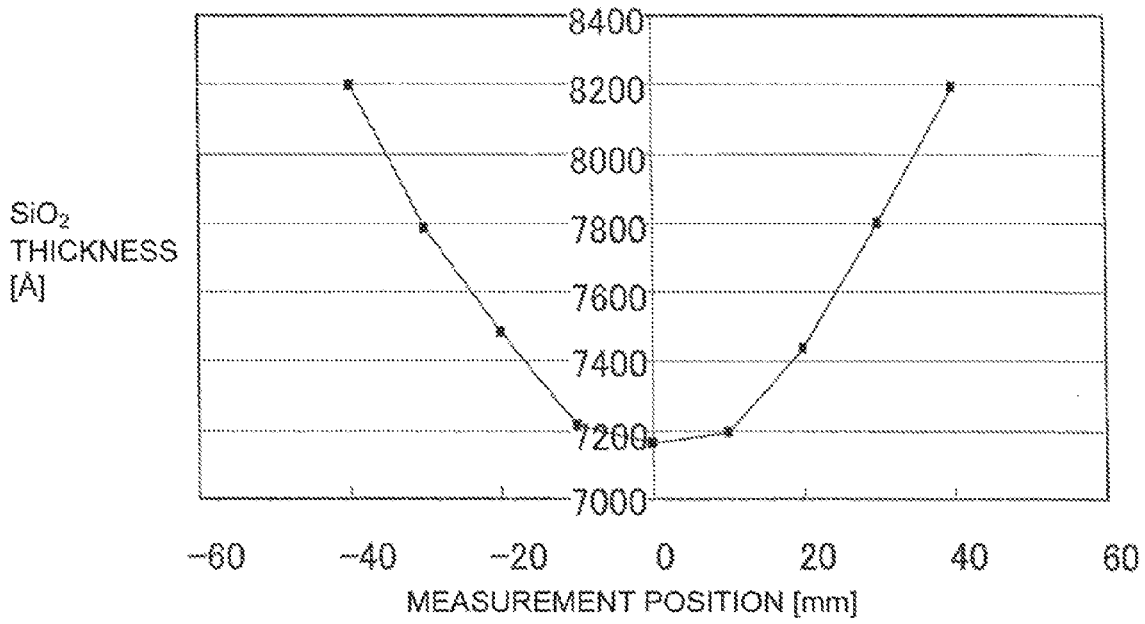
FIG. 10 is a graph showing the result of polishing by rotating a polishing pad at 80 rpm and an object to be polished at 40 rpm.

An object to be polished 20 was polished by using a polishing pad 10 having lattice-shaped grooves 15 formed on the whole surface and having a diameter of 300 mm, and rotating the polishing pad 10 and the object to be polished 20 at different numbers of revolutions (refer to FIG. 5). The width of the grooves 15 formed on the first polishing region 11 of the polishing pad 10 was 0.5 mm and the pitch was 1.5 mm. A polishing pad 10 made of foamed rigid urethane was used. As the object to be polished 20, a Si wafer 20*b* having a diameter of 100 mm where an $SiO_2$ film 20*a* having a thickness of 10,000 Å is formed thereon was used. The polishing pad 10 was rotated at 80 rpm and the object to be polished 20 was rotated at 40 rpm in the same direction. The results are shown in FIG. 10. The 9 points in the range between −40 to 40 mm on the horizontal axis representing a measurement position in FIG. 10 correspond to the measurement positions 1 to 9 in FIG. 8. As shown in FIG. 10, the thickness of $SiO_2$ in the center region was reduced, showing that a concave surface was formed as shown in FIG. 7B. In the case of FIG. 10, the curvature radius was R 13 million mm.

Example 3

Figure 7C:
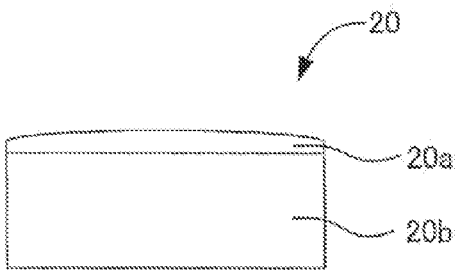
FIG. 7C is a schematic view showing a Si wafer having an $SiO_2$ film polished into a convex state by a polishing method according to the present invention.
Figure 11:
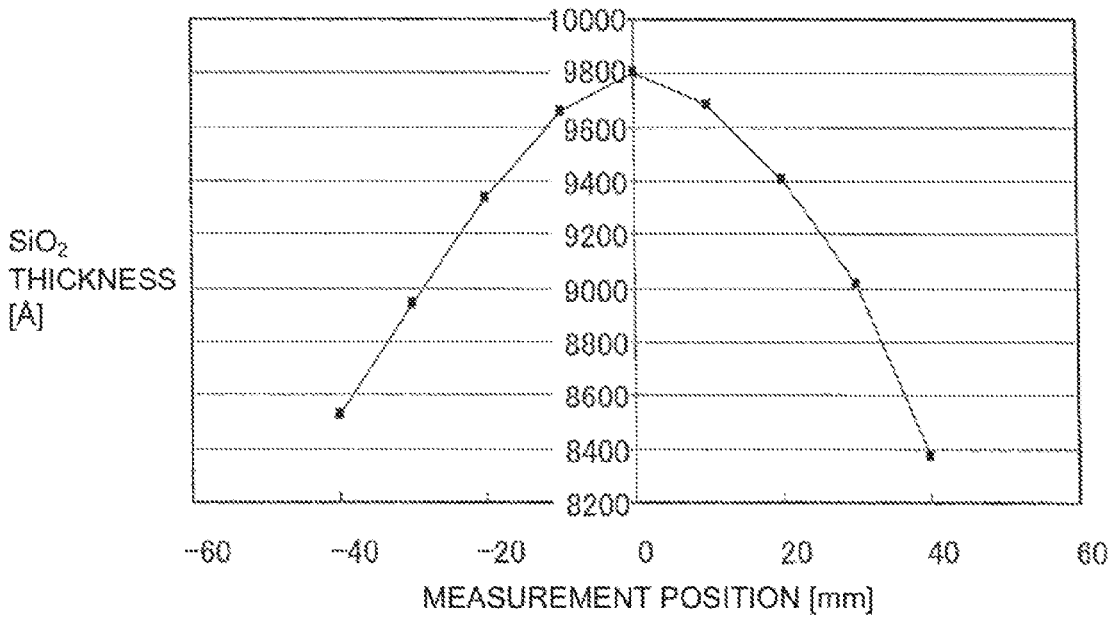
FIG. 11 is a graph showing the result of polishing by rotating a polishing pad at 40 rpm and an object to be polished at 80 rpm.

An object to be polished 20 was polished by using the polishing pad 10 of Example 2 and rotating the polishing pad 10 and the object to be polished 20 at different numbers of revolutions (refer to FIG. 5). As the object to be polished 20, a Si wafer 20*b* having a diameter of 100 mm where an $SiO_2$ film 20*a* having a thickness of 10,000 Å is formed thereon, which is the same as in Example 2 was used. The polishing pad 10 was rotated at 40 rpm and the object to be polished 20 was rotated at 80 rpm in the same direction. The results are shown in FIG. 11. As shown in FIG. 11, the thickness of $SiO_2$ in the center region was increased showing that a convex surface was formed as shown in FIG. 7C. In the case of FIG. 11, the curvature radius was R 8.9 million mm.

Example 4

Figure 12:
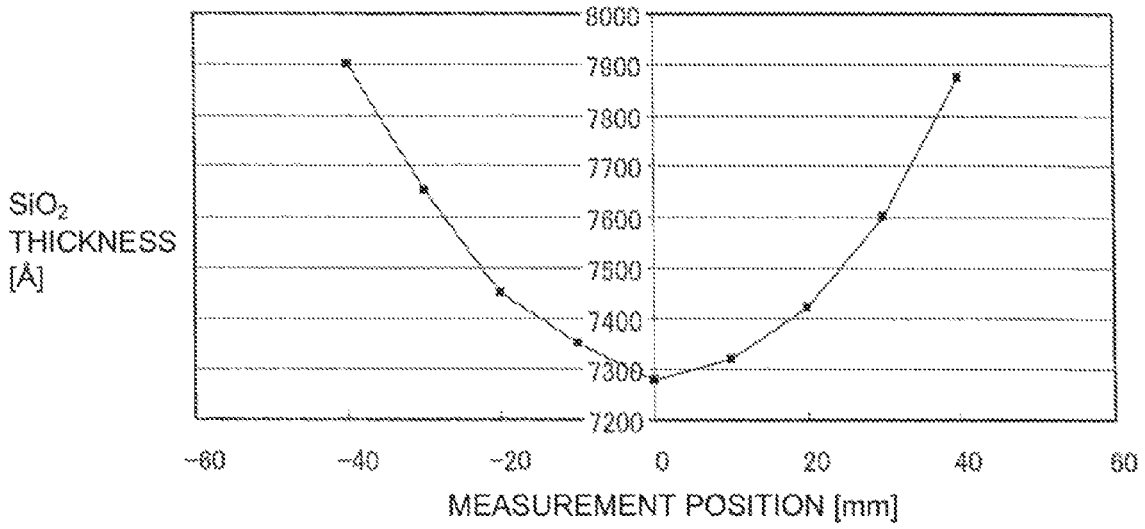
FIG. 12 is a graph showing the result of polishing while different slurries are supplied to a region on the center side and to a region on the outer side, respectively.

An object to be polished 20 was polished by using a polishing pad 10 having concentric grooves 15 formed on the whole surface and having a diameter of 300 mm (refer to FIGS. 6A and 6B). The width of the grooves 15 formed on the first polishing region 11 of the polishing pad 10 was 0.5 mm and the pitch was 1.5 mm. A polishing pad 10 made of foamed rigid urethane was used. As the object to be polished 20, a Si wafer 20*b* having a diameter of 100 mm where an $SiO_2$ film 20*a* having a thickness of 10,000 Å is formed thereon was used. The object to be polished 20 was polished while different slurries were supplied to the region of the polishing pad 10 on the center side of the central part 20*c* of the object to be polished 20 and to the region of the polishing pad 10 on the outer side of the central part 20*c* of the object to be polished 20, respectively, in a radial direction of the polishing pad 10. The slurries contained colloidal silica as abrasive grain, and pH of the slurry supplied to the region on the center side was 9 to 10 and pH of the slurry supplied to the region on the outer side was 13. The results are shown in FIG. 12. As shown in FIG. 12, the thickness of $SiO_2$ in the center region was reduced showing that a concave surface was formed as shown in FIG. 7B.

DESCRIPTION OF REFERENCE SYMBOLS

1 CMP apparatus
2 Platen
3 Polishing head
4 Slurry supply unit
10 Polishing pad
11 First polishing region
12 Second polishing region
15 Groove
20 Object to be polished
20*a* $SiO_2$ film
20*b* Si wafer
20*c* Central part

What is claimed is:

1. A method of polishing an object to be polished, wherein a surface of the object to be polished is processed into a concave or convex state by:

placing the object to be polished on a polishing pad over a boundary between a first polishing region and a second polishing region, the polishing pad having a first polishing region where grooves are formed and a second polishing region where grooves are formed in a different state from that of the first polishing region, and either one of the first polishing region and the second polishing region being formed on a region on a center side, and the other being formed on a region on an outer side in a radial direction on the surface of the polishing pad; and polishing the object to be polished by rotating the polishing pad and the object to be polished.

2. The method of polishing an object to be polished according to claim 1, wherein the first polishing region is formed on the center side of the polishing pad and the surface of the object to be polished is processed into a concave state.

3. The method of polishing an object to be polished according to claim 2, wherein concentric grooves are formed in the first polishing region of the polishing pad.

4. The method of polishing an object to be polished according to claim 1, wherein the first polishing region is formed on the outer side of the polishing pad and the surface of the object to be polished is processed into a convex state.

5. The method of polishing an object to be polished according to claim 4, wherein concentric grooves are formed in the first polishing region of the polishing pad.

6. The method of polishing an object to be polished according to claim 1, wherein concentric grooves are formed in the first polishing region of the polishing pad.

7. The method of polishing an object to be polished according to claim 1, wherein the polishing pad and the object to be polished are rotated at number of revolutions different from each other so as to make polishing speed have a distribution on the surface of the object to be polished.

8. The method of polishing an object to be polished according to claim 7, wherein the surface of the object to be polished is processed into a concave state by making the number of revolutions of the polishing pad larger than that of the object to be polished.

9. The method of polishing an object to be polished according to claim 7, wherein the surface of the object to be polished is processed into a convex state by making the number of revolutions of the polishing pad smaller than that of the object to be polished.

10. The method of polishing an object to be polished according to claim 1, wherein one of two slurries having different properties from each other is supplied to the region of the polishing pad on the center side of the central part of the object to be polished in a radial direction of the polishing pad, and the other slurry is supplied to the region of the polishing pad on the outer side of the central part of the object to be polished, respectively, or supplying a specified slurry to only one of the said two regions to process the surface of the object to be polished into a concave or convex state.

11. The method of polishing an object to be polished according to claim 10, wherein the two slurries each have a different pH.

* * * * *